United States Patent [19]

Bachmann et al.

[11] 4,155,382

[45] May 22, 1979

[54] APPARATUS FOR TENSIONING AND LOCKING HOOPING BANDS

[75] Inventors: Hans Bachmann, Fahrweid; Ernst Albiez, Widen, both of Switzerland

[73] Assignee: Borbe-Wanner AG., Switzerland

[21] Appl. No.: 855,188

[22] Filed: Nov. 28, 1977

[30] Foreign Application Priority Data

Dec. 3, 1976 [CH] Switzerland ..... 15273/76

[51] Int. Cl.[2] ..... B21F 9/02

[52] U.S. Cl. ..... 140/93.2

[58] Field of Search ..... 140/93.2, 93.4; 100/27, 100/30, 32, 33 R

[56] References Cited

U.S. PATENT DOCUMENTS

| | | | |
|---|---|---|---|
| 3,648,739 | 3/1972 | Angarola | 140/93.2 |
| 3,690,350 | 9/1972 | Sansum | 140/93.2 |

*Primary Examiner*—Lowell A. Larson

*Attorney, Agent, or Firm*—Roylance, Abrams, Berdo & Farley

[57] ABSTRACT

The primary thrust drive for a punch and die set which presses together two superimposed portions of the band to be locked utilizes the mechanical advantage afforded by a symmetrical angle lever pair. The arms of the levers are turned about a pair of pinions by a pneumatic piston drive. At the end of the other arms is a pressure roller which rides on a pressure surface of a pressure plate to convert the rotation movement of the angle levers to an outward linear movement on the pressure plate towards the pinions. The pressure plate carries the die. The pressure surface upon which each of the rollers acts is made to have a cylindrical curvature away from the roller. This has the effect of making more linear the characteristic increase of the mechanical advantage of the toggle arrangement as a function of the outward travel of the pressure plate and thereby making the adjustment of the die travel less critical.

14 Claims, 2 Drawing Figures

APPARATUS FOR TENSIONING AND LOCKING HOOPING BANDS

BACKGROUND OF THE INVENTION

The invention relates to an apparatus for locking band hoops on packages by permanent deformation of two superimposed portions of a flexible hooping band. The deformation of the portions is brought about by pressing down a die arranged in raisable and lowerable manner over the portions. The bottom of the die is fixed to a pressure plate which is guided in the casing of the apparatus and toward a punch mounted in a base plate of the apparatus and positioned below the portions.

There are fundamentally two groups of known apparatus for locking band hoops. In the first group, locking is accomplished by means of a locking sleeve which is placed over the superimposed portions of the hooping band and is deformed together with the band portions to form a non-detachable connection. In the second group, which apparatus is used mainly for locking flexible metallic bands or strips, locking takes place without a sleeve, i.e. through reciprocal permanent deformation of the superimposed portions of the hooping band.

In the case of the second group of apparatus, the forces to be applied for deforming the superimposed portions of the hooping band are very large because a non-detachable connection has to be produced without using a locking sleeve. To this end, the band portions are placed between a punch mounted in the base plate of the apparatus and a raisable and lowerable die spaced above the punch. The die is pressed down with great force onto the band portions either manually or by means of a power drive until the permanent deformation of the band portions necessary for the non-detachable connection is achieved.

In order to obtain a permanent non-detachable connection between the band portions, it is important that the movable die is precisely aligned with the punch mounted in the base plate in order to bring about a perfect cooperation between the protuberances and depressions arranged in both these tools. However, this is not sufficient for obtaining a suitable connection if the force applied is insufficient. In known apparatus of this type, the necessary force is provided through force transmission linkages, such as toggle linkages. When such transmission linkages are used within a small lifting or stroke range, rapidly increasing forces are exerted. If the stroke travel is set too far, the resulting excessive force can lead to the destruction of the apparatus during the locking process. If the stroke travel setting is made too short, the necessary minimum deformation for the locking process is not obtained.

BRIEF SUMMARY OF THE INVENTION

The problem of the present invention is to so develop an apparatus of the type indicated hereinbefore that the value of the pressure force is varying in an uniform manner as a function of the stroke, and the lateral forces acting on the die are absorbed in the immediate vicinity thereof and conducted into the base plate.

According to the invention, this problem is solved in that the top of the pressure plate is constructed as a pressure surface for the end of a first arm of two toggle levers mounted with a horizontal spindle in the casing, whereby the force for operating the toggle levers is applied.

DESCRIPTION OF THE PREFERRED EMBODIMENTS

Figure 1:
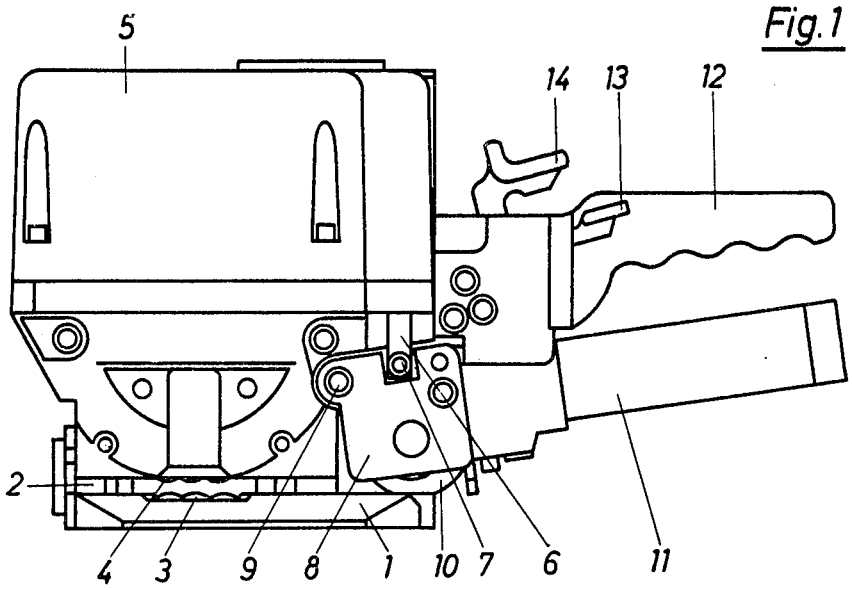
FIG. 1 is a side view of an apparatus for tensioning and locking band hoops, with juxtaposed locking and tensioning parts.

The apparatus shown in FIG. 1 for tensioning and locking band hoops or straps has a base plate above which is positioned a band channel, accessible from one side, for inserting not shown superimposed band portions of a flexible hooping band. In base plate 1 there is mounted a punch 3 which faces a movable die 4 fixed to a primary thrust drive mechanism. Punch 3 and die 4 are deformed at their pressure surfaces in such a way that on pressing down of the die 4, the superimposed band portions are permanently deformed to give a permanent connection.

A casing 5 in which is fitted a primary thrust drive mechanism for the die 4, as will be described hereinafter relative to FIG. 2, and which is connected to base plate 1, is positioned above band channel 2. A further secondary thrust drive mechanism with a thrust rod 6 is fitted in the casing 5 alongside the primary thrust drive mechanism. Thrust rod 6 is articulated via a swivel joint 7 to a tensioning housing 8 which is in turn mounted via a swivel joint 9 on casing 5. Thus, tensioning housing 8 can be pivoted about toggle joint 9 by means of the associated secondary thrust drive mechanism via thrust rod 6.

In the tensioning housing 8 there is pivotably mounted a tensioning roller 10 which is operable either manually or, as shown in FIG. 1, by a motor drive 11, e.g. an electric or pneumatic motor. For placing the hooping band in band channel 2, the tensioning housing 8 with the tensioning roller 10 is raised by the thrust rod 6. The die 4 is raised by its associated primary thrust drive mechanism. When the hooping band is inserted, the tensioning housing 8 is lowered and the tensioning roller 10 is pressed onto the hooping band and rotated by the drive 11 for tensioning.

A handle 12 is fixed to the casing 5. On the handle are provided two operating levers 13, 14. Operating lever 13 is used to raise and lower tensioning roller 10 and tensioning housing 8, while the band is tensioning by lever 14. The primary thrust drive mechanism of die 4 is operated automatically or by a not shown button on the back of casing 5.

Figure 2:
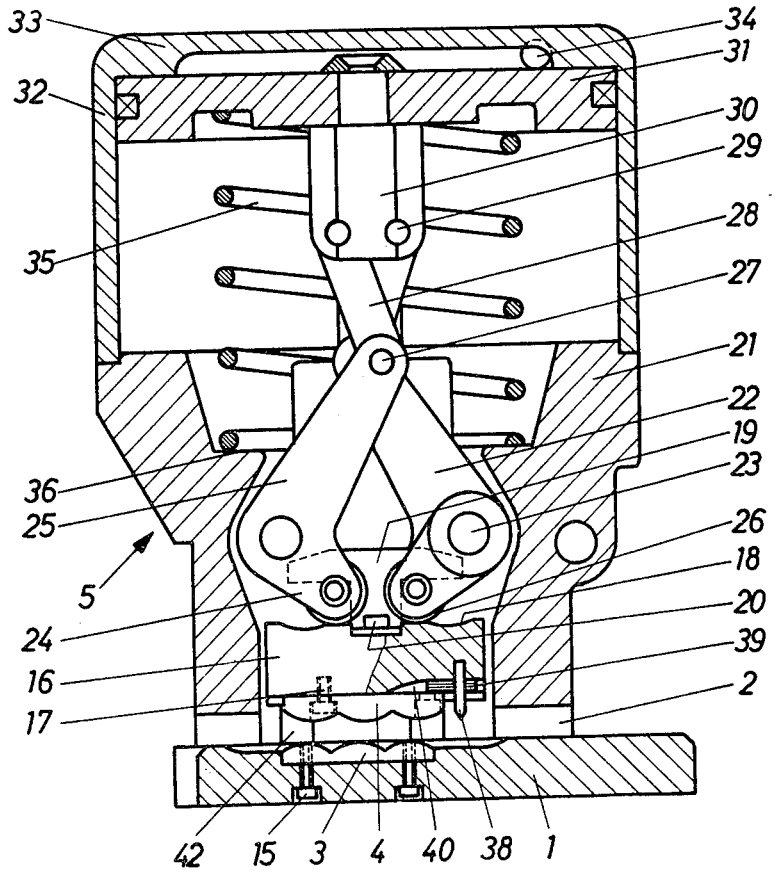
FIG. 2 is a vertical section through the locking part of the apparatus of FIG. 1.

FIG. 2 shows a section through the casing 5. Punch 3 is mounted on the base plate 1 by means of screws 15. Opposite punch 3 the die 4 is fixed to a pressure plate 16 by means of screws 17. Screws 20 are used to fix a cam 19 to the surface 18 of the pressure plate 16, the cam having a T-shaped profile. Two two-armed angles or toggle levers 22 with a horizontal spindle 23 are pivoted in lower part 21 of the casing 5. Each angle lever 22 has a smaller first arm 24 and a longer second arm 25. At the free end of the first arm 24 of the two angle levers 22 there is mounted in rotary manner a pressure roller 26 whose spindle projects into a cam 19.

The free end of the second arm 25 is connected by means of a swivel joint 27 with a connecting arm 28, which in turn is connected via a swivel joint 29 to a bearing bracket 30. Bearing bracket 30 is connected to a piston 31 which is guided in movable manner in the upper part 32 of casing 5. At the transition from upper part 32 into cover part 33 a feed line 34 is provided by means of which a fluid pressure medium can be supplied to the primary thrust piston drive formed by components 30 to 33. As the thrust piston drive 30 to 33 is single-acting, a compression spring 35 is provided on the bottom of piston 31 and supported on a shoulder 36 within lower part 21. When the pressure on the top of piston 31 is relieved, the spring 35 raises the thrust piston drive and consequently the pressure plate 16 with die 4.

If a pressure medium, e.g. compressed air, is supplied by feed line 34 to the thrust piston drive 30 to 33, angle levers 22 are pivoted as a result of the movement of piston 31 so that the pressure plate 16 is lowered. Pressure rollers 26 hereby roll on the surface 18 of pressure plate 16 and produce a corresponding pressure force on die 4.

If it is desired to control the degree of the development of the pressure force with the travel, this can be done with non-planar surface configurations within the roller path of the pressure rollers 26. The pressure surface 18 has concave cylindrical portions against which the pressure rollers 26 act and the axis of which is parallel to the axis of the pressure rollers. Due to these curvatures of the pressure surface, the pressure force is made more uniform as a function of movement of the pressure plate 16, i.e. as a function of the stroke.

A cutting blade 38 is fixed by means of a bolt 39 to the bottom of pressure plate 16. Bolt 39, e.g. a spring cotter is located in a slot 40 and is prevented from falling out by the die 4. The cutting blade 38 may be readily replaced when it has suffered a certain degree of wear by merely removing first the die 4.

Guide means 42 fixed in the base plate and projecting into corresponding bores of the pressure plate 16 are provided for the precise alignment of the plate 16 with the die 4 relative to the punch 3.

We claim:

1. An apparatus for locking two superimposed portions of a strap by deforming the portions, comprising a base plate with a punch mounted therein;

a casing fixed to said base plate;

a pressure plate movably mounted for guided movement toward and away from said punch, said pressure plate having a pressure surface facing away from said punch and a die surface facing toward said punch;

a die fixedly mounted on said die surface and facing said punch; and force means mounted in said casing and operatively coupled to said pressure plate by toggle linkage means, said force means having a reciprocating member, said linkage means having a first link which is pivotally coupled intermediate its ends to said casing and pivotally coupled at one end to said reciprocating member, the other end of said first link being in sliding contact with said pressure surface;

said pressure surface having a first concave cylindrical portion in the area of sliding contact with said other end of said first link.

2. An apparatus according to claim 1, wherein said linkage means has a second link which is pivotally coupled intermediate its ends to said casing and pivotally coupled at one of its ends to said reciprocating member, the other end of said second link being in sliding contact with said pressure surface;

said pressure surface having a second concave cylindrical portion in the area of sliding contact with said other end of said second link.

3. An apparatus according to claim 2, wherein said links are symmetrically located relative to a central axis extending in the direction of pressure plate movement and are oppositely directed.

4. An apparatus according to claim 1, wherein said first link has a pressure roller rotatably mounted at said other end for contacting said pressure surface.

5. An apparatus according to claim 1, wherein said pressure plate has at least one guide bore and said base plate has at least one guide means extending therefrom which is received in said guide bore to guide said pressure plate.

6. An apparatus according to claim 1, wherein a cutting blade is releasably mounted in said pressure plate, said pressure plate having a slot formed therein opening on said die surface and being at least partially covered by said die; and wherein a pin extends through said blade and into said slot between said pressure plate and die.

7. An apparatus according to claim 1, wherein said first link comprises two fixedly coupled, angularly oriented arms, and is pivotally coupled to said casing adjacent the juncture of said arms.

8. An apparatus for locking two superimposed portions of a strap by deforming the portions, comprising a base plate with a punch mounted therein;

a casing fixed to said base plate;

a pressure plate movably mounted for guided movement toward and away from said punch, said pressure plate having a pressure surface facing away from said punch and a die surface facing toward said punch;

a die fixedly mounted on said die surface and facing said punch; and force means mounted in said casing and operatively coupled to said pressure plate by toggle linkage means, said force means having a reciprocating member, said linkage means having first and second links, each of which is pivotally coupled intermediate its ends to said casing and pivotally coupled at one end to said reciprocating member, the other ends of said links being in sliding contact with said pressure surface, said links being oppositely directed.

9. An apparatus according to claim 8, wherein said links are symmetrically located relative to a central axis extending in the direction of pressure plate movement.

10. An apparatus according to claim 8, wherein each said link has a pressure roller rotatably mounted at its other end for contacting said pressure surface.

11. An apparatus according to claim 8, wherein said pressure plate has at least one guide bore and said base plate has at least one guide means extending therefrom which is received in said guide bore to guide said pressure plate.

12. An apparatus according to claim 8, wherein a cutting blade is releasably mounted in said pressure plate, said pressure plate having a slot formed therein opening on said die surface and being at least partially covered by said die; and wherein a pin extends through said blade and into said slot between said pressure plate and die.

13. An apparatus according to claim 8, wherein each link comprises two fixedly coupled, angularly oriented arms, and is pivotally coupled to said casing adjacent the juncture of said arms.

14. An apparatus for locking two superimposed portions of a strap by deforming the portions, comprising a base plate with a punch mounted therein;

a casing fixed to said base plate;

a pressure plate movably mounted for guided movement toward and away from said punch, said pressure plate having a pressure surface facing away from said punch and a die surface facing toward said punch;

a die fixedly mounted on said die surface and facing said punch;

force means mounted in said casing and operatively coupled to said pressure plate for driving said pressure plate; and a cutting blade releasably mounted in said pressure plate;

said pressure plate having a slot formed therein opening on said die surface and being at least partially covered by said die, and a pin extending through said blade and into said slot between said pressure plate and die.

* * * * *